US005594403A

United States Patent [19]

Taga et al.

[11] Patent Number: 5,594,403

[45] Date of Patent: Jan. 14, 1997

[54] HIGH-VOLTAGE FUSE BOX

[75] Inventors: Shunji Taga; Takeshi Yomura, both of Yokkaichi, Japan

[73] Assignee: Sumitomo Wiring Systems, Ltd., Yokkaichi, Japan

[21] Appl. No.: 355,273

[22] Filed: Dec. 12, 1994

[30] Foreign Application Priority Data

Dec. 20, 1993 [JP] Japan ..... 5-067813

[51] Int. Cl.[6] ..... H01H 85/02

[52] U.S. Cl. ..... 337/186; 337/187

[58] Field of Search ..... 439/622; 337/186, 337/187, 188, 189, 191

[56] References Cited

U.S. PATENT DOCUMENTS 3,038,977 7/1962 Arthur et al. ..... 337/188

3,163,728 12/1964 Martin ..... 337/186

5,167,541 12/1992 Alves et al. ..... 337/186

5,203,724 4/1993 Casey .

*Primary Examiner*—Lincoln Donovan

*Attorney, Agent, or Firm*—Greenblum & Bernstein P.L.C.

[57] ABSTRACT

A high-voltage fuse box comprising: a box body; at least one first connection plate which is electrically conductive and is secured to the box body; at least one second connection plate which is electrically conductive and is secured to the box body: a plate fuse which has opposite fixing terminals such that the fixing terminals are fixed to one end portion of the first connection plate and one end portion of the second connection plate with machine screws, respectively; a first electric wire which has a first terminal; and a second electric wire which has a second terminal such that the first and second terminals are fixed to the other end portion of the first connection plate and the other end portion of the second connection plate with machine screws, respectively.

5 Claims, 3 Drawing Sheets

HIGH-VOLTAGE FUSE BOX

BACKGROUND OF THE INVENTION

The present invention generally relates to a high-voltage fuse box and more particularly, to a high-voltage fuse box designed for use at a voltage of 120 V or the like and suitable for use in an electric car, etc., which is provided between a main battery and various electrical devices in the electric car.

Generally, in motor vehicles, the power source has a voltage of 12 V and fuses, fusible links, etc. are designed for use at a voltage of 32 V or less. Meanwhile, materials and sizes of a casing such as a fuse box and a cover are also designed on the basis of heat value obtained at a voltage of 12 V.

However, in an electric car, such a problem arises that since a power source has a voltage of, for example, 120 V, a low-voltage fuse box for a general motor vehicle cannot be used for the electric car as it is.

SUMMARY OF THE INVENTION

Accordingly, an essential object of the present invention is to provide, with a view to eliminating the above mentioned drawback in the prior art, a high-voltage fuse box optimum for an electric car, etc.

In order to accomplish this object of the present invention, a high-voltage fuse box according to the present invention comprises: a box body; at least one first connection plate which is electrically conductive and is secured to the box body; at least one second connection plate which is electrically conductive and is secured to the box body; a plate fuse which has opposite fixing terminals such that the fixing terminals are fixed to one end portion of the first connection plate and one end portion of the second connection plate with machine screws, respectively; a first electric wire which has a first terminal; and a second electric wire which has a second terminal such that the first and second terminals are fixed to the other end portion of the first connection plate and the other end portion of the second connection plate with machine screws, respectively.

The first and second connection plates are made of material superior in heat resistance, dielectric strength and strength to that of the contact bonding terminals of the electric wires, for example, iron, and are made four to five times thicker than the contact bonding terminals of the electric wires so as to be less likely to be damaged at the time of melting of the plate fuse.

Meanwhile, the first connection plate may branch off so as to be connected to, for example, two second connection plates through two plate fuses. A threaded hole for fixing the contact bonding terminal of the electric wire is formed at one end portion of each of the first and second connection plates, while a threaded hole for fixing the plate fuse is formed at the other end portion of each of the first and second connection plates. In addition, a small hole for fixing each of the first and second connection plates to the box body is formed at a central portion of each of the first and second connection plates. The first and second connection plates are fitted into recessed portions formed on an upper face of a bottom wall of the box body and a boss in each of the recessed portions is fitted into the small hole so as to be molten by heat such that the first and second connection plates are secured to the box body. Opposite end portions of each of the first and second connection plates are fixed to the contact bonding terminal of the electric wire and the plate fuse, respectively. Furthermore, rubber plugs are fitted into through-holes for receiving the electric wires, which are formed on the box body.

In the present invention, the first and second electrically conductive connection plates are secured to the box body and the opposite fixing terminals of the plate fuse are, respectively, fixed to one end portion of the first connection plate and one end portion of the second connection plate with the machine screws, while the terminals of the electric wires are, respectively, fixed to the other end portion of the first connection plate and the other end portion of the second connection plates with the machine screws. Therefore, even if the plate fuse is heated, the heat produced in the plate fuse is less likely to be transferred to the terminals of the electric wires by such functions of the first and second connection plates as heat dissipation and heat insulation and thus, such an inconvenience is eliminated that coating of the electric wires, which is made of synthetic resin, is molten.

Furthermore, the terminals of the electric wires are, respectively, fixed to the other end portion of the first connection plate and the other end portion of the second connection plate with the machine screws separately without fastening a single machine screw on the fixing terminal placed on the terminal of the electric wire. Therefore, such a problem does not arise that at the time of replacement of the plate fuse, the terminals of the electric wires are moved and thus, are disconnected from thin conductors of the electric wires.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the accompanying drawings.

DETAILED DESCRIPTION OF THE INVENTION

Figure 2:
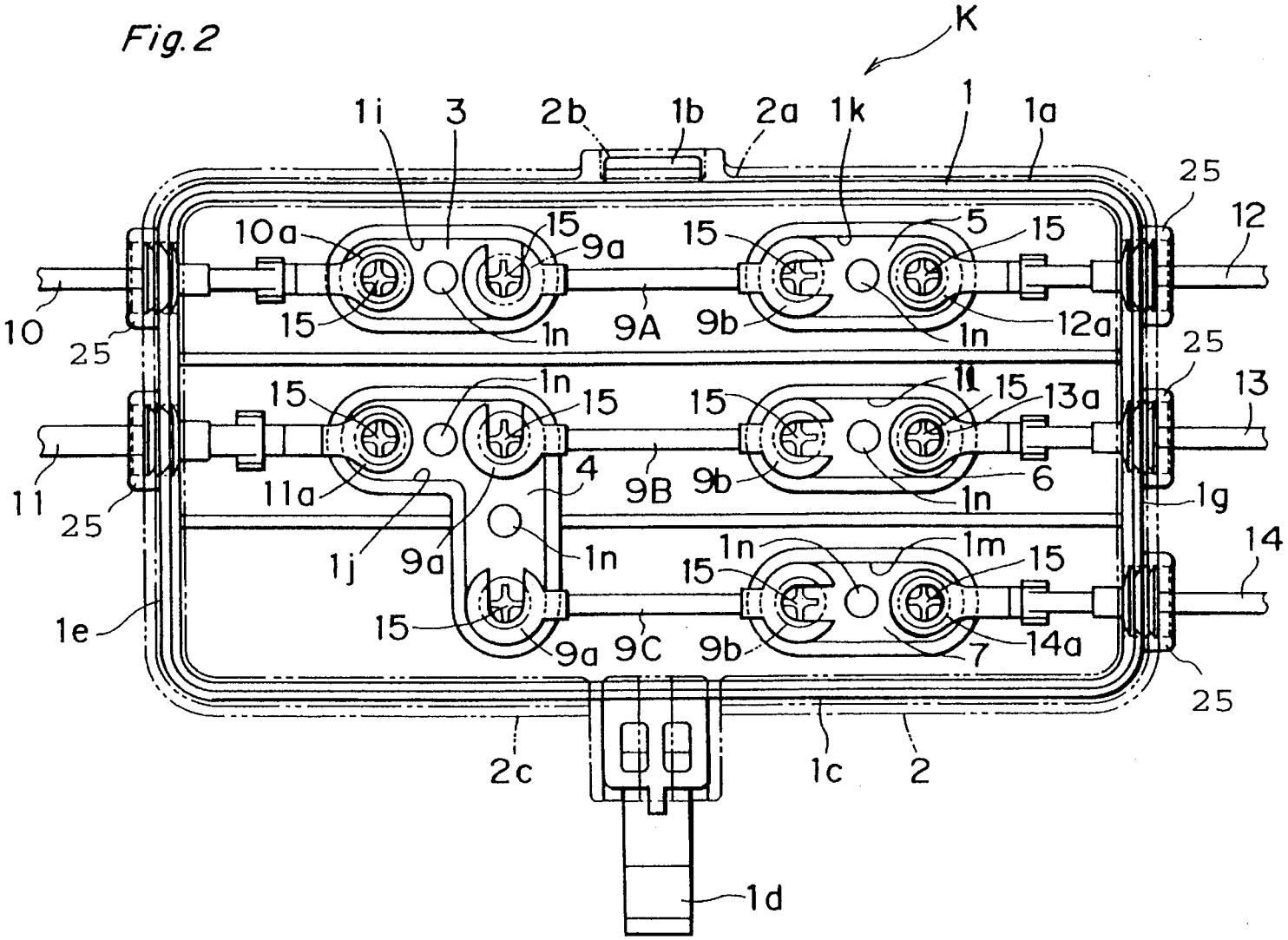
FIG. 2 is a top plan view of the high-voltage fuse box of FIG. 1 as observed by removing a lid from the high-voltage fuse box.
Figure 3:
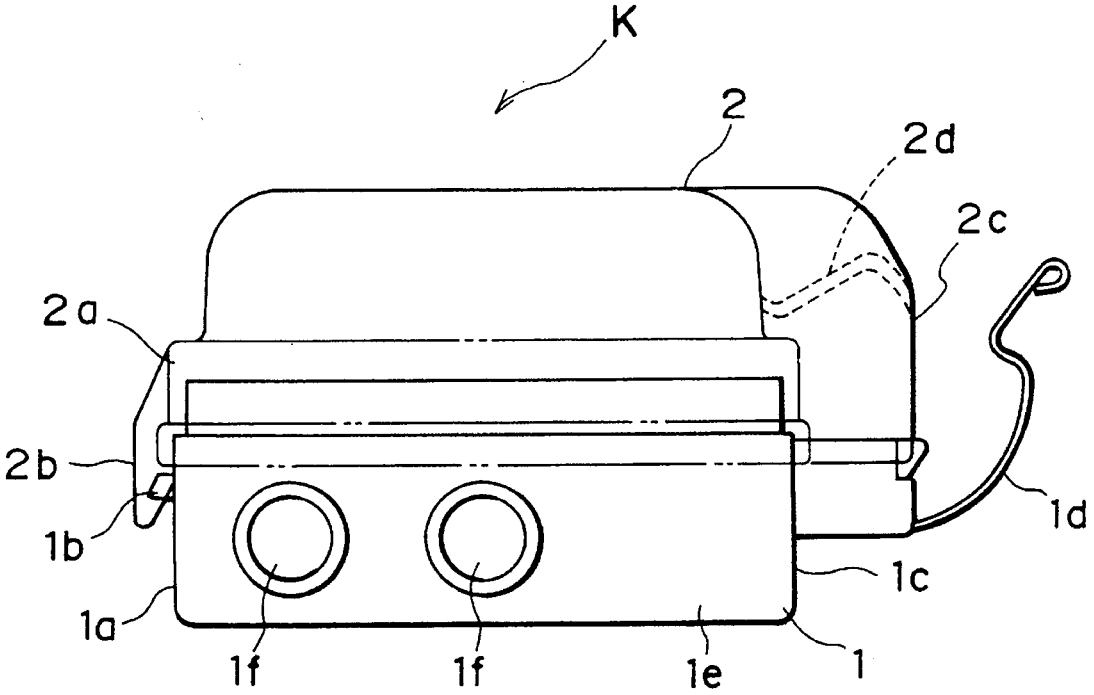
FIG. 3 is a left side elevational view of the high-voltage fuse box of FIG. 2.
Figure 4:
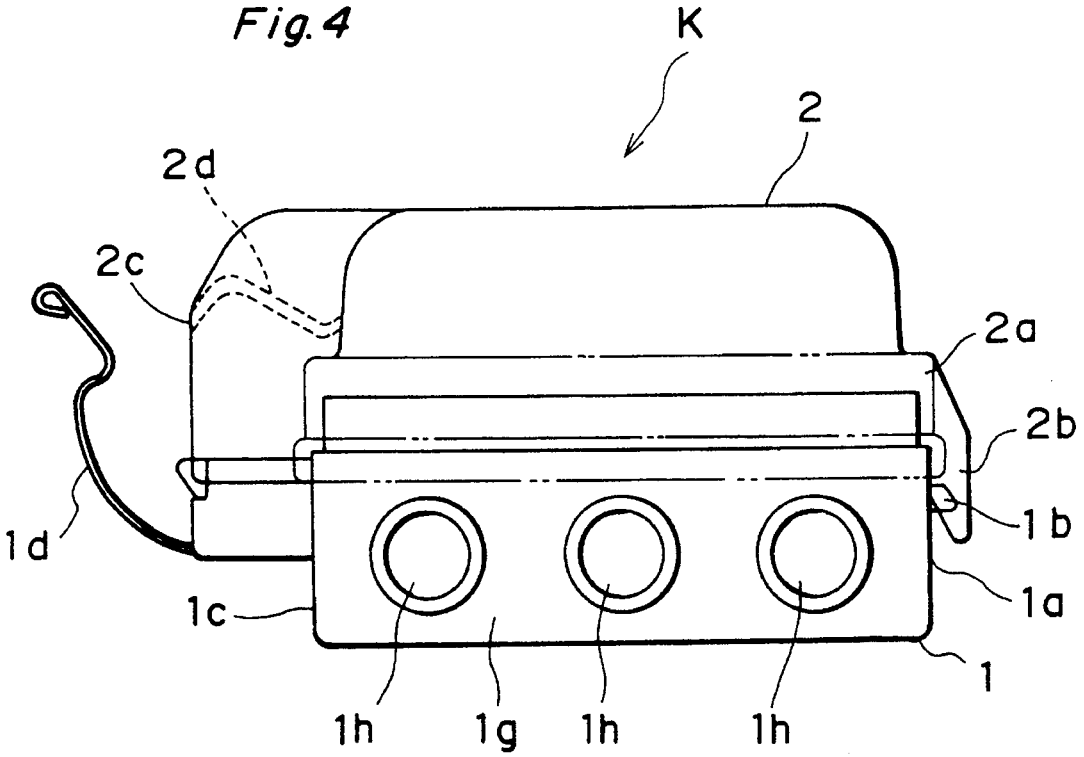
FIG. 4 is a right side elevational view of the high-voltage fuse box of FIG. 2.

Referring now to the drawings, there is shown in FIGS. 2 to 4, a high-voltage fuse box K according to one embodiment of the present invention. The high-voltage fuse box K includes a rectangular box body 1 made of synthetic resin and a lid 2 for covering an upper opening of the box body 1 in watertight state through a packing (not shown), which is made of synthetic resin. A projection 1*b* formed on one outer side face 1*a* of the box body 1 is brought into engagement with a recess 2*b* formed on one outer side face 2*a* of the lid 2 and a buckle 1*d* provided on the other outer side face 1*c* of the box body 1 is brought into engagement with a hollow 2*d* formed at an upper portion of the other outer side face 2*c* of the lid 2 such that the lid 2 is secured to the box body 1.

Two through-holes if are formed on one outer end face 1*e* of the box body 1, while three through-holes 1*h* are formed on the other outer end face 1*g* of the box body 1. On an upper surface of a bottom wall of the box body 1, an elliptic recessed portion 1*i* and a reverse L-shaped recessed portion 1*j* are formed in the vicinity of the outer end face 1*e*, while elliptic recessed portions 1*k*, 1*l* and 1*m* are formed in the vicinity of the outer end face 1*g*. First connection plates 3 and 4 made of electrically conductive metal and having elliptic and reverse L-shaped forms, respectively ,are fitted into the recessed portions 1*i* and 1*j*, respectively, in the vicinity of the outer end face 1*e* of the box body 1, while second connection plates 5, 6 and 7 made of electrically conductive metal and having elliptic shape are, respectively, fitted into the recessed portions 1*k*, 1*l* and 1*m* in the vicinity of the outer end face 1*g* of the box body 1. The first connection plates 3 and 4 are connected to a main battery, while the second connection plates 5 to 7 are connected to various electrical devices.

Figure 1:
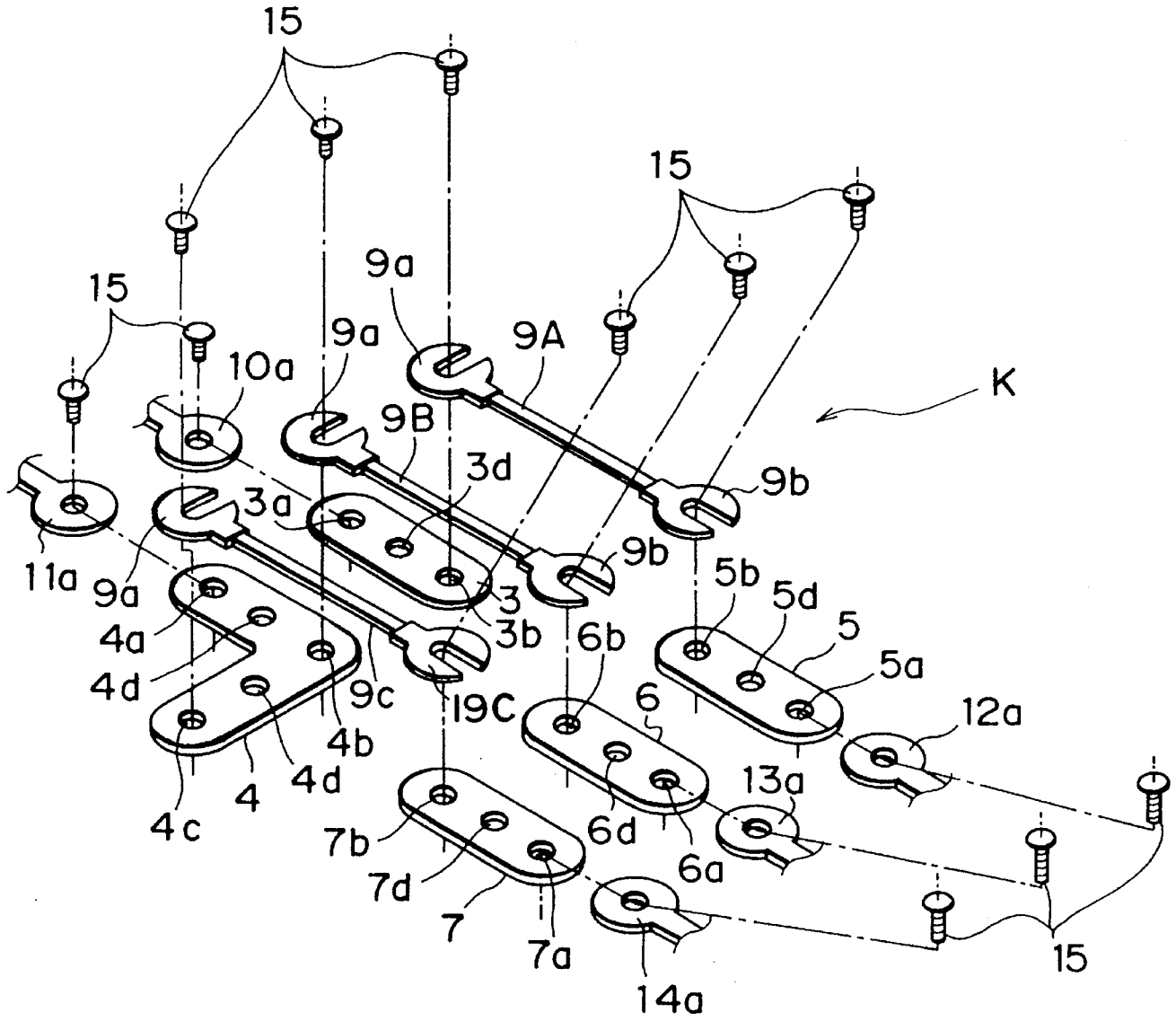
FIG. 1 is an exploded perspective view of electrical members accommodated in a high-voltage fuse box according to the present invention.

As shown in detail in FIG. 1, the elliptic connection plates 3, 5, 6 and 7 are formed, at opposite end portions of each of the connection plates 3, 5, 6 and 7, with threaded holes 3*a* and 3*b*, 5*a* and 5*b*, 6*a* and 6*b* and 7*a* and 7*b*, respectively. Threaded holes 4*a*, 4*c* and 4*b* are, respectively, formed at opposite end portions and a corner portion of the reverse L-shaped connection plate 4. Small holes 3*d*, 5*d*, 6*d* and 7*d* are formed at a central portion of each of the elliptic connection plates 3, 5, 6 and 7, respectively. Two small holes 4*d* are, respectively, formed between the threaded holes 4*a* and 4*b* and between the threaded holes 4*b* and 4*c*.

A boss in projects upwardly from a bottom face of each of the recessed portions 1*i*, 1*k*, 1*l* and 1*m* and is fitted into each of the small holes 3*d*, 5*d*, 6*d* and 7*d* of the connection plates 3, 5, 6 and 7. Likewise, two bosses 1*n* project upwardly from a bottom face of the recessed portion 1*j* and are, respectively, fitted into the small holes 4*d* of the connection plate 4. Subsequently, by melting an upper end portion of each of the bosses 1*n* with heat, the connection plates 3 to 7 are secured to the bottom faces of the recessed portions 1*i* to 1*n*. Meanwhile, plate fuses 9A, 9B and 9C are of high-voltage type and have forked fixing terminals 9*a* and 9*b* formed at opposite end portions of each of the plate fuses 9A to 9C, respectively.

Terminals 10*a* and 11*a* of electric wires 10 and 11 are, respectively, inserted from outside into the two through-holes 1*f* on the outer end face 1*e* of the box body 1. A watertight rubber plug 25 is fitted into each of the through-holes 1*f*. Meanwhile, terminals 12*a*, 13*a* and 14*a* of electric wires 12, 13 and 14 are, respectively, inserted from outside into the three through-holes 1*h* on the outer end face 1*g* of the box body 1 and the watertight rubber plug 25 is fitted into each of the through-holes 1*h*. The terminal 10*a* of the electric wire 10 is fixed to the first connection plate 3 by screwing a machine screw 15 through the terminal 10*a* into the threaded hole 3*a* formed at one end portion of the first connection plate 3, while the terminal 11*a* of the electric wire 11 is fixed to the first connection plate 4 by screwing the machine screw 15 through the terminal 11*a* into the threaded hole 4*a* formed at one end portion of the first connection plate 4. Likewise, the terminal 12*a* of the electric wire 12 is fixed to the second connection plate 5 by screwing the machine screw 15 through the terminal 12*a* into the threaded hole 5*a* formed at one end portion of the second connection plate 5. The terminal 13*a* of the electric wire 13 is fixed to the second connection plate 6 by screwing the machine screw 15 through the terminal 13*a* into the threaded hole 6*a* formed at one end portion of the second connection plate 6. The terminal 14*a* of the electric wire 14 is fixed to the second connection plate 7 by screwing the machine screw 15 through the terminal 14*a* into the threaded hole 7*a* formed at one end portion of the second connection plate 7.

Furthermore, the fixing terminal 9*a* disposed at one end portion of the plate fuse 9A is fixed to the first connection plate 3 by screwing the machine screw 15 through the fixing terminal 9*a* into the threaded hole 3*b* formed at the other end portion of the first connection plate 3, while the fixing terminal 9*b* disposed at the other end portion of the plate fuse 9A is fixed to the second connection plate 5 by screwing the machine screw 15 through the fixing terminal 9*b* into the threaded hole 5*b* formed at the other end portion of the second connection plate 5. Similarly, the fixing terminal 9*a* disposed at one end portion of the plate fuse 9B is fixed to the first connection plate 4 by screwing the machine screw 15 through the fixing terminal 9*a* into the threaded hole 4*b* formed at the corner portion of the first connection plate 4, while the fixing terminal 9*b* disposed at the other end portion of the plate fuse 9B is fixed to the second connection plate 6 by screwing the machine screw 15 through the fixing terminal 9*b* into the threaded hole 6*b* formed at the other end portion of the second connection plate 6. Furthermore, the fixing terminal 9*a* disposed at one end portion of the plate fuse 9C is fixed to the first connection plate 4 by screwing the machine screw 15 through the fixing terminal 9*a* into the machine hole 4*c* formed at the other end portion of the first connection plate 4, while the fixing terminal 9*b*disposed at the other end portion of the plate fuse 9C is fixed to the second connection plate 7 by screwing the machine screw 15 through the fixing terminal 9*b* into the threaded hole 7*b* formed at the other end portion of the second connection plate 7.

By the above described arrangement of the high-voltage fuse box K of the present invention, even if the plate fuses 9A to 9C are heated by applying a voltage of 120 V thereto, the heat produced in the plate fuses 9A to 9C is less likely to be transferred to the terminals 10*a* to 14*a* of the electric wires 10 to 14 by such functions of the connection plates 3 to 7 as heat dissipation and heat insulation. As a result, such an inconvenience associated with prior art that coating of the electric wires 10 to 14, which is made of synthetic resin, is molten is eliminated.

Meanwhile, the terminals 10*a* to 14*a* of the electric wires 10 to 14 are, respectively, secured to the connection plates 3 to 7 by screwing the machine screws 15 through the terminals 10*a* to 14*a* into the threaded holes 3*a* to 7*a* formed at one end portion of each of the connection plates 3 to 7 and the fuse plates 9A to 9C are secured to the connection plates 3 to 7 by screwing the machine screws 15 through the fuse plates 9A to 9C into the threaded holes 3*b*, 4*c* and 5*b* to 7*b* formed at the other end portion of each of the connection plates 3 to 7 and the threaded hole 4*b* formed at the corner portion of the connection plate 4. Therefore, the terminal of the electric wire is not fixed to the connection plate by fastening a single machine screw on the plate fuse placed on the terminal of the electric wire. Accordingly, such a problem does not arise that at the time of replacement of the plate fuses 9A to 9C, the terminals 10*a* to 14*a* of the electric wires 10 to 14 are moved and thus, are disconnected from thin conductors of the electric wires 10 to 14.

As is clear from the foregoing description of the high-voltage fuse box of the present invention, each of the fixing terminals of the plate fuses is fixed by the machine screw to one end portion of each of the connection plates secured to the box body and each of the terminals of the electric wires is fixed by the machine screw to the other end portion of each of the connection plates. Therefore, even if heat is produced in the fuse plates, the heat produced in the fuse plates is less likely to be transferred to the terminals of the electric wires by such functions of the connection plates as heat dissipation and heat insulation and thus, such an inconvenience that coating of the electric wires, which is made of synthetic resin, is molten is eliminated. Furthermore, such a problem does not arise that at the time of replacement of the plate fuses, the terminals of the fuses are displaced and thus, are disconnected from the thin conductors of the electric wires.

What is claimed is:

1. A high-voltage fuse box comprising:

a box body;

at least one first connection plate, the at least one first connection plate having first and second opposite end portions, the at least one first connection plate being electrically conductive and being secured to the box body;

at least one second connection plate, the at least one second connection plate having first and second opposite end portions, the at least one second connection plate being electrically conductive and being secured to the box body;

a plate fuse which has opposite first and second fixing terminals such that the first terminal is fixed to the first end portion of the first connection plate and the second fixing terminal is fixed to the first end portion of the second connection plate, respectively, with machine screws;

a first electric wire which has a first terminal; and a second electric wire which has a second terminal such that the first and second terminals are fixed to the second end portion of the first connection plate and the second end portion of the second connection plate, respectively, with machine screws, whereby heat from the plate fuse is dissipated by the first and second connection plates.

2. A high-voltage fuse box as claimed in claim 1, wherein the first connection plate is connected to a battery and the second connection plate is connected to an electrical device, wherein the first connection plate branches off so as to be connected to a plurality of the second connection plates through a plurality of the plate fuses.

3. A high-voltage fuse box as claimed in claim 1, wherein the plate fuse is adapted to be operated at a voltage of 120 V or more.

4. A high-voltage fuse box as claimed in claim 2, wherein the plate fuses are adapted to be operated at a voltage of 120 V or more.

5. A high-voltage fuse box as claimed in claim 1, wherein the box body includes first and second through-holes, the first and second electric wires extending through the first and second through-holes, respectively, and first and second watertight plugs being fitted in the first and second through-holes, respectively.

* * * * *